United States Patent [19]

Shepler et al.

[11] Patent Number: 4,508,408

[45] Date of Patent: Apr. 2, 1985

[54] ANTI-DECOUPLING MECHANISM FOR AN ELECTRICAL CONNECTOR ASSEMBLY

[75] Inventors: Eric F. Shepler, Sidney; Anthony W. Knapp, Laurens, both of N.Y.

[73] Assignee: Allied Corporation, Morristown, N.J.

[21] Appl. No.: 493,496

[22] Filed: May 11, 1983

[51] Int. Cl.[3] ..... H01R 13/623

[52] U.S. Cl. ..... 339/89 M; 339/DIG. 2

[58] Field of Search ..... 339/89 R, 89 C, 89 M, 339/90 R, 90 C, DIG. 2; 285/82, 89, 92; 267/156; 192/72, 81 C

[56] References Cited

U.S. PATENT DOCUMENTS

| | | | |
|---|---|---|---|
| 718,366 | 1/1903 | Freund | 83/345 |
| 957,504 | 5/1910 | Frenot | 411/143 |
| 1,011,871 | 12/1911 | Smoke | 411/331 |
| 2,928,514 | 3/1960 | Clausing et al. | 192/81 C |
| 3,018,097 | 1/1962 | Johansson | 267/156 |
| 3,222,046 | 12/1965 | Thorner | 267/156 |
| 3,517,371 | 6/1970 | Buckley | 339/89 |
| 3,532,197 | 10/1970 | King | 267/156 |
| 3,594,700 | 7/1971 | Nava | 339/89 R |
| 3,598,210 | 8/1971 | Barr | 192/72 |
| 3,646,495 | 2/1972 | Cowmeadow | 339/46 C |
| 3,663,926 | 5/1972 | Brandt | 339/89 R |
| 3,669,472 | 6/1972 | Nadsady | 339/89 R |
| 3,786,396 | 1/1974 | Kemmer | 339/89 R |
| 3,801,954 | 4/1974 | Dorrel | 339/90 R |
| 3,917,373 | 11/1975 | Peterson | 339/89 R |
| 3,971,614 | 7/1976 | Paoli et al. | 339/89 |
| 4,007,953 | 2/1977 | Powell | 339/89 R |
| 4,030,798 | 6/1977 | Paoli | 339/89 R |
| 4,056,298 | 11/1977 | Cooper | 339/89 M |
| 4,066,315 | 1/1978 | Arneson | 339/89 M |
| 4,165,910 | 8/1979 | Anderson | 339/89 M |
| 4,359,255 | 11/1982 | Gallusser et al. | 339/90 R |
| 4,427,100 | 1/1984 | Rude et al. | 192/81 C |
| 4,437,552 | 3/1984 | Toyama | 192/81 C |

*Primary Examiner*—John McQuade
*Attorney, Agent, or Firm*—C. D. Lacina

[57] ABSTRACT

An annular, radially expansible/contractible spiral spring (50) includes inner and outer circumferential faces (54, 56) and a tab (60) disposed perpendicularly to the annulus and between the faces, the spring being adapted to mount a coupling nut (30) on a plug shell (20) and provide means for resisting rotation of the coupling nut in both coupling/uncoupling directions, the spiral spring having faces (52) overlapping and opposite ends (**58*a*, 58*b*) free with tab (60) being disposed at one end (58*b*) and adapted to be received in successive detents (40) disposed around an end face (37) of the coupling nut, each detent (40) having angularly spaced sidewalls (42, 44) with one sidewall (42) being radially disposed and the other sidewall (44) being skewed and acutely-angled relative to a radius, the sidewalls being adapted to be driven against the tab to tighten (contract) or loosen (expand) the spring annulus relative to the plug shell, sidewall (44) being adapted to cam tab (60**) radially from its detent and allow coupling nut rotation.

5 Claims, 7 Drawing Figures

ANTI-DECOUPLING MECHANISM FOR AN ELECTRICAL CONNECTOR ASSEMBLY

This invention relates to an anti-decoupling mechanism for an electrical connector assembly.

Devices for resisting rotation of a coupling nut due to vibration have utilized a spring-detent approach. In "Electrical Connector Assembly Having Anti-Decoupling Mechanism" U.S. Pat. No. 4,109.990 issuing Aug. 29, 1978 to Waldron et al, a straight spring beam has its opposite ends mounted to an inner wall of a coupling nut and a medial tooth portion thereon tangent to and adapted to successively engage with retchet teeth formed on one of the two connectors when the coupling nut is rotated in either direction relative to the connector assembly. A disadvantage of the spring-detent is constant wearing between teeth and possible nut rotation of one or two ratchet clicks to introduce slight axial back-off of the shells from their full mating which could lead to shell hammering and/or adverse radio frequency interference.

An annular ring comprising a flat band of metal wound about itself a couple of times such that opposite ends thereof are overlapping themselves has been used to rotatably mount a coupling nut to its respective connector shell, the ring only serving to retain (i.e., longitudinally captivate) the coupling nut about its shell. It would be desirable to combine rotation resisting and retaining functions to thereby eliminate parts and reduce overall assembly time.

This invention is an anti-decoupling mechanism for an electrical connector assembly of the type comprising plug and receptacle connectors and a coupling nut rotatably mounted on the plug connector and including a radial flange having an outer end wall facing rearwardly, the plug connector including an annular groove having an end wall facing forwardly and an annular flange abutting the radial flange.

The anti-decoupling mechanism is characterized by a plurality of detents disposed in the end wall of the radial flange and an annular, radially expansible/contractible, spring interference fit in the annular groove for captivating the coupling nut and including a tab releasably received in the detents for resisting rotation of the coupling nut. The spring is comprised of a thin, flat metal plate spiraled about itself more than once to form an annulus having circumferential inner and outer faces, an opening sized to interference fit about the annular groove and a width adapted to substantially fill the longitudinal gap between the forward and rearward end walls, the spring being generally rectangular and cross-section, having flat faces thereof overlapping such that the long and short dimensions of the cross-section are disposed radially and longitudinally relative to a radius through the connector axis and having opposite ends thereof free. One end portion of the spring is substantially perpendicular to the plate and forms the tab, the tab being disposed between its circumferential faces. Each detent includes angularly spaced sidewalls which, upon application of external torque, are driven against the tab, one sidewall being radially extending and serving to force the spring ends apart and expand the spring annulus from its interference fit whereby the spring will slide about the annular groove, and the other sidewall being acutely angled and skewed relative to a radius through the connector axis and serving to initially force the spring ends together to contract the spring and increase the interference fit of the annulus whereby the spring will not slide relative to the groove but an increase in external torque serving to drive the tab radially upward on the skewed sidewall and outward from its detent to allow the coupling nut to rotate and advance the next detent whereupon the tab snaps therein and the spring radially contracts into its interference fit.

One way of carrying out the invention is described in detail below with reference to the drawings which illustrate one specific embodiment of this invention, in which.

Figures 1, 2, 3:
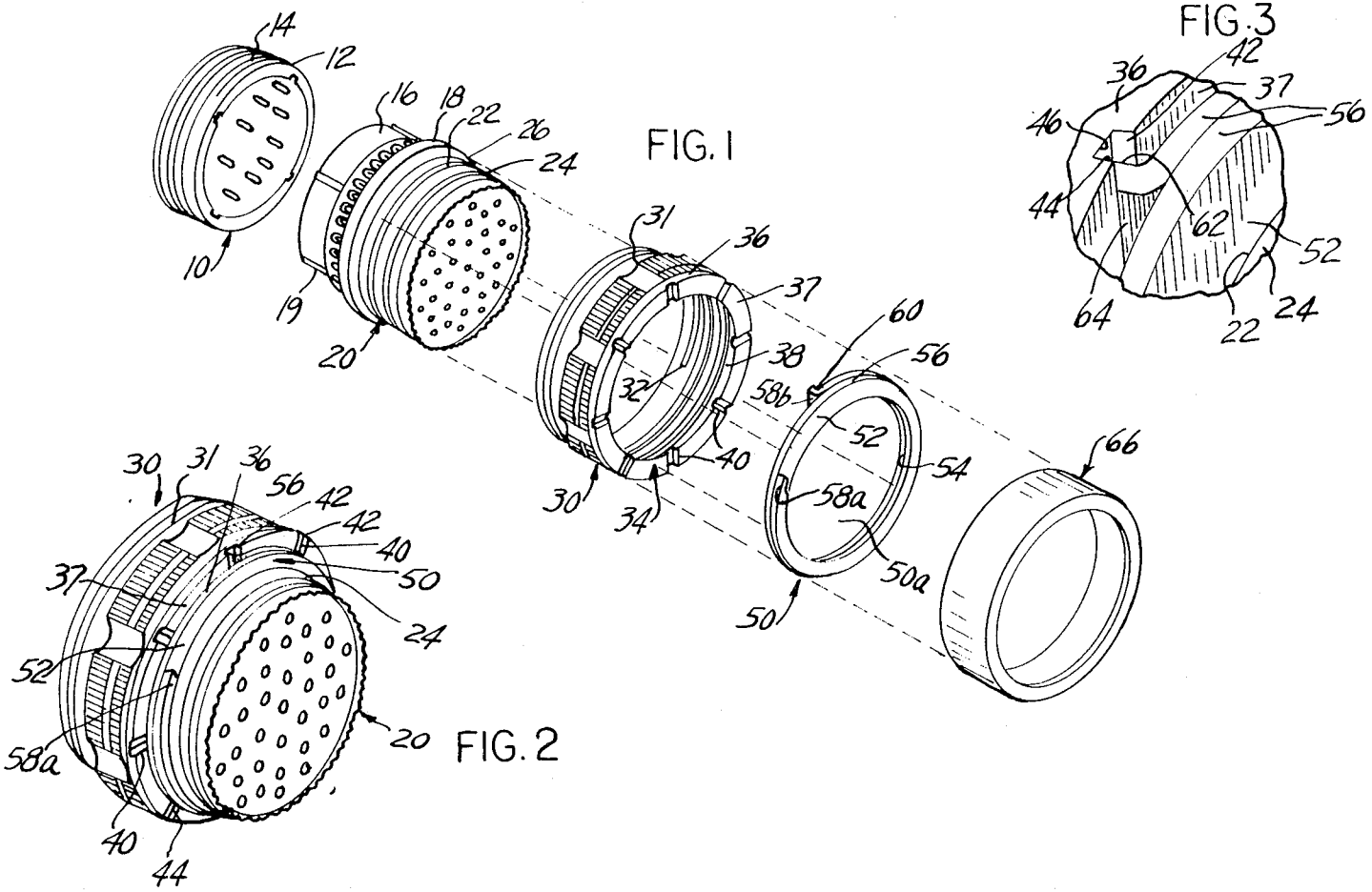
FIG. 1 is an expoloded view of an electrical connector assembly having an anti-decoupling device according to the present invention.
FIG. 2 is a view of a plug shell provided with the anti-decoupling device.
FIG. 3 is an enlarge detailed view of a portion of FIG. 2.

Referring now to the drawings, FIG. 1 shows an exploded view of an electrical connector assembly aligned along its primary axis for mating and comprising a receptacle shell 10, a plug shell 20 and a coupling nut 30 rotatably mounted on the plug shell for connecting to the receptacle shell. The receptacle shell 10 is generally cylindrical and includes a forward portion 12 provided with thread 14 on its outside periphery. The plug shell 20 is generally cylindrical and includes forward and rearward portions 16, 24, an annular flange 18 and a circumferential annular groove 26 circumjacent annular flange 18, the annular flange being disposed medially of its shell portions and extending annularly therearound and the annular groove having a forwardly facing end wall 22 (shown best in FIGS. 3, 4 and 6).

The coupling nut 30 comprises a generally cylindrical coupling sleeve 31 having internal thread 32 adapted to engage with the external thread 14 when coupling nut is 30 rotated and a radial flange 34 adapted to seat against annular flange 18 of plug shell 20 for rotation thereabout, annular flange 34 having circumferential inner and outer faces 38, 36 and a rearwardly facing outer end wall 37, circumferential inner face 38 being adapted to circumpose annular groove 26 of plug shell 10 in a clearance fit.

Preferably and in accord with this invention a plurality of engageable detents 40 are disposed on end wall 37 of coupling nut 30 and an annular, radially expansible/-contractible spiral spring 50 having opposite ends **58*a*, 58*b* and a central opening 50*a* is adapted to be interference fit about annular groove 26, the spring including a tab 60 adapted to be releasably fit in each of the detents. Spring 50 with tab 60 serves functions of both mounting coupling nut 30 to plug shell 20 and of resisting unwanted rotation of coupling nut 30 relative to plug shell 20**.

Each of the detents 40 disposed around end wall 37 radiate outwardly from the primary axis of the assembly, are generally equiangularly spaced from one another and extend radially between the circumferential inner and outer faces 38 and 36.

Spring 50 is of a resilient material, such as metal, and comprises a substantially flat plate 52 of generally rectangular cross-section spiraled about itself to form an annulus having inner and outer circumferential faces 54, 56 and plate faces overlapping, the inner circumferential face 54 defining opening 50*a* and being of a diameter less than annular groove 26 so as to interference fit therewithin and opposite ends 58*a*, 58*b* allowing the spring to radially expand or contract depending upon whether spring ends 58*a*, 58*b* are driven away from or towards one another. When the spring is spiraled, the cross-section has its long and short dimensions, respectively, disposed radially and longitudinally relative to the primary axis.

Spring end 58*b* is bent transversely of flat plate 52 to form an L-shaped end portion and define tab 60 which is adapted to fit within each of the detents 40, the tab being disposed between the circumferential faces 54, 56.

A cover 66 is sized to be assembled over spring 50 and fit about coupling nut 30 for protecting the spring.

FIG. 2 shows coupling nut 30 mounted to plug shell 20 by spring 50 and tab 60 positioned within one of the plurality of detents 40. The width of spring 50 substantially fills the longitudinal gap between end walls 37, 22 relative to annular groove 26.

FIG. 3 shows an enlarged detail of spring 50 positioned in annular groove 26 and tab 60 disposed within detent 40, the spring being longitudinally rearward of and abutting both end wall 37 of coupling nut 30 and end wall 22 of annular groove 26, the tab 60 having first and second abutment faces 62, 64 and a forward face 66, the detent 40 having angularly spaced sidewalls 42, 44 and a forward wall 46. Outer circumferential face 56 is substantially coextensive with outer circumferential face 36.

Figure 4:
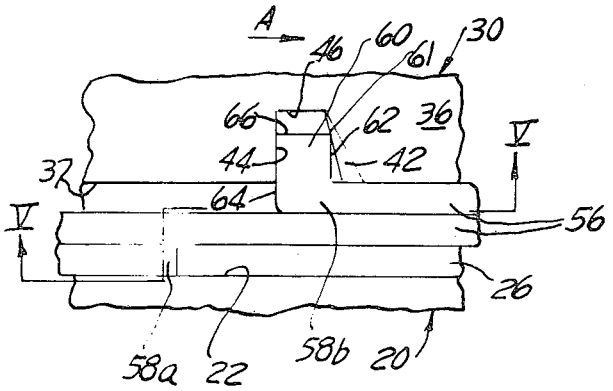
FIG. 4 is an enlarged view looking down on engagement between a locking spring and a detent.
Figure 6:
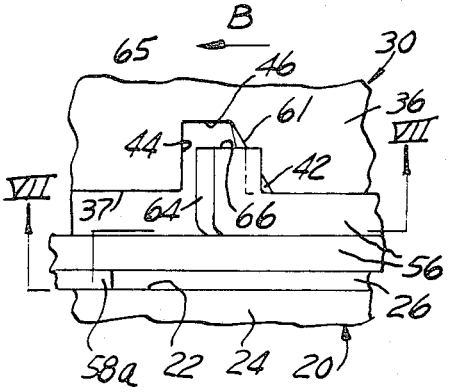
FIG. 6 is a view, similar to that of FIG. 4, showing an uncoupling rotation of the coupling nut.

FIGS. 4 and 6 show tab 60 positioned within one detent 40. In FIG. 4, coupling direction rotation of coupling nut 30 due to an external torque is shown by an arrow "A" pointing to the right. In FIG. 6, uncoupling direction rotation of coupling nut 30 relative to plug shell 20 due to an external torque is shown by arrow "B" pointing to the left.

FIG. 4 shows detent 40 including the angularly spaced sidewalls 42, 44 and the forward wall 46, each of the sidewalls extending longitudinally into end wall 37 of radial flange 34 and the sidewalls 42, 44, respectively, being generally acutely-angled and in a plane skewed relative to a radius drawn through the primary axis. Tab 60 has first abutment face 62 abutting skewed sidewall 42, second abutment face 64 abutting radial sidewall 44 and its forward face 66 facing forward wall 46, a lowermost edge 61 of tab of 60 being adapted to contact skewed sidewall 42. The opposite ends 58*a*, 58*b* of spring 50 abut end walls 22, 37 and the overlapped plates 52 substantially fill the axial gap between the end walls 22, 37 to prevent any rearward movement of coupling nut 30.

Figure 5:
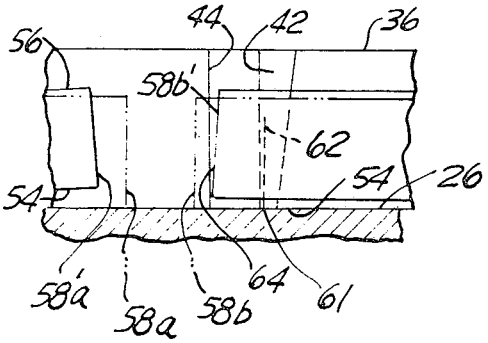
FIG. 5 is an elevation view taken along lines V—V of FIG. 4.

FIG. 5 is a side view of FIG. 4 showing tab 60 received within detent 40. Spring 50, shown by phantom lines, is disposed below circumferential outer face 36 and interference fit non-rotatably within annular groove 26. Upon sufficient external coupling torque on coupling nut 30 relative to plug shell 20 sidewall 44 pushes against first abutment face 64 of tab 60 whereby ends 58*a*, 58*b* of spring 50 are pushed away from one another and the spring annulus tends to radially expand and be removed from a close interference fitment about annular groove 26 and slide relative thereto to allow coupling rotation to proceed.

FIG. 6 shows sidewall 42 pushing against second abutment face 62 of tab 60 so that ends 58*a*, 58*b* of spring 50 are pushed towards one another and the spring annulus tends to radially contract and increase friction forces to rotation of spring 50 relative to annular groove 26.

Figure 7:
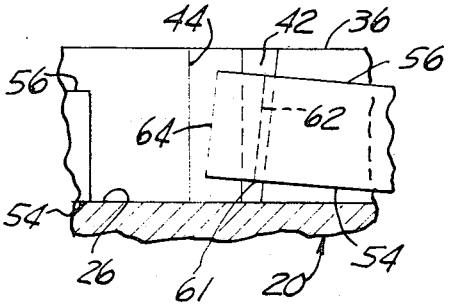
FIG. 7 is a view taken along lines VII—VII of FIG. 6 showing substantially radial expansion of locking tab and locking spring relative to the plug shell.

FIG. 7 shows that upon increase of external torque, lowermost edge 61 of tab 60 is cammed radially upward on sidewall 42 and tab 60 expands radially to allow edge 61 to race on circumferentialy face 36 and advance to the next detent 40 whereupon the spring radially contracts back into an interference fit within annular groove 26.

We claim:

1. An anti-decoupling mechanism for an electrical connector assembly, the connector assembly having a primary axis and comprising a pair of connector members and a coupling nut including a radial flange rotatably mounted to one of said connector members for coupling to the other connector member, said one connector member including an annular groove having a forwardly facing end wall and said radial flange having a rearwardly facing outer end wall, said anti-decoupling mechanism being adapted to resist both coupling and uncoupling rotation of the coupling nut and characterized by:

a plurality of detents disposed around said outer end wall, each said detent including a pair of angularly spaced sidewalls with one of said sidewalls being generally radially disposed and the other of said sidewalls being skewed and acutely-angled relative to a radius drawn through the primary axis; and a radially expansible/contractible annular spring interference fit within said annular groove and including a locking tab releasably disposed within one of said detents, the spring annulus being adapted to expand/contract, respectively, upon application of an external torque, the interference fitment between the spring annulus and the annular groove providing frictional forces of an amount sufficient to resist unwanted relative rotation therebetween, application of an external coupling/uncoupling torque to the coupling nut driving one and the other said sidewall, respectively, against the tab and causing the spring annulus to radially expand or contract, the radial expansion reducing the frictional interference forces and allowing the spring to slide relative to the annular groove, and the radial contraction initially increasing the frictional interference forces preventing relative rotation until sufficient external torque cams the tab radially upward on the sidewall and outward of its detent and the spring annulus expands whereby the coupling nut rotates and advances the next successive detent into engagement with the tab whereupon the spring radially contracts into its interference fit within the annular groove.

2. The invention as recited in claim 1 further characterized by said spring comprising a substantially flat plate of generally rectangular cross-section and having opposite ends, said plate being spiraled about itself more than once such that the faces of said plate are overlapping and said cross-section has its long and short dimensions, respectively, disposed radially and longitudinally relative to the axis, said plate having inner and outer circumferential faces with said tab being disposed therebetween.

3. The invention as recited in claim 2 wherein said radial flange includes circumferential inner and outer faces with the inner face circumposing said one connector member and further characterized by each of said sidewalls extending longitudinally into said outer end wall of the radial flange; the outer face extending circumferentially from detent-to-detent to provide a race for the tab to ride upon when cammed radially outwardly of its detent during uncoupling rotation of the coupling nut, and the outer face being substantially coextensive with outer circumferential face.

4. The invention as recited in claim 1 wherein said one connector member includes an annular flange and said radial flange is abutted against the annular flange for rotation thereabout and further characterized by means for mounting the coupling nut to said one connector member, said mounting means comprising said spring having said its ends abutting, respectively, the end wall of said annular groove and the end wall of said radial flange with said overlapped plates substantially filling the axial gap between the end walls to prevent any axial movement of coupling nut.

5. The invention as recited in claim 4 wherein said tab is integrally formed with said spring adjacent the end and is disposed in a plane defined by a radius passing through the axis and is approximately at 90 degrees with the plane of the spring annulus to form an L-shaped end portion.

* * * * *